US009038731B2

(12) United States Patent
Edwards

(10) Patent No.: US 9,038,731 B2
(45) Date of Patent: May 26, 2015

(54) WORKOVER RISER COMPENSATOR SYSTEM

(71) Applicant: Enovate Systems Limited, Aberdeen (GB)

(72) Inventor: Jeffrey Edwards, Aberdeen (GB)

(73) Assignee: Enovate Systems Limited, Aberdeen (GB)

( * ) Notice: Subject to any disclaimer, the term of this patent is extended or adjusted under 35 U.S.C. 154(b) by 0 days.

(21) Appl. No.: 14/246,831

(22) Filed: Apr. 7, 2014

(65) Prior Publication Data

US 2014/0338920 A1 Nov. 20, 2014

Related U.S. Application Data

(63) Continuation of application No. 13/456,376, filed on Apr. 26, 2012, now Pat. No. 8,727,014, which is a continuation of application No. 12/307,379, filed as application No. PCT/GB2007/002516 on Jul. 5, 2007, now abandoned.

(30) Foreign Application Priority Data

Jul. 6, 2006 (GB) ..... 06/13393.8

(51) Int. Cl.

| | |
|---|---|
| ***E21B 17/02*** | (2006.01) |
| ***E21B 33/038*** | (2006.01) |
| ***E21B 41/00*** | (2006.01) |
| ***E21B 17/08*** | (2006.01) |
| ***E21B 19/00*** | (2006.01) |

(52) U.S. Cl.

CPC ..... *E21B 41/0007* (2013.01); *E21B 17/085* (2013.01); *E21B 33/038* (2013.01); *E21B 19/006* (2013.01)

(58) Field of Classification Search

CPC ..... E21B 17/04; E21B 17/085; E21B 33/038; E21B 34/045

USPC ..... 166/350, 339, 340, 345, 365, 367; 405/224.2, 224.4

See application file for complete search history.

(56) References Cited

U.S. PATENT DOCUMENTS

| | | | | | |
|---|---|---|---|---|---|
| 3,785,445 | A | * | 1/1974 | Scozzafava | 175/5 |
| 3,917,006 | A | * | 11/1975 | Kellner | 175/5 |
| 3,999,617 | A | * | 12/1976 | Ilfrey et al. | 175/7 |
| 4,059,148 | A | * | 11/1977 | Blomsma | 166/359 |
| 4,176,722 | A | * | 12/1979 | Wetmore et al. | 175/7 |
| 4,281,716 | A | | 8/1981 | Hall | |
| 4,466,487 | A | * | 8/1984 | Taylor, Jr. | 166/339 |
| 5,771,974 | A | * | 6/1998 | Stewart et al. | 166/336 |

(Continued)

FOREIGN PATENT DOCUMENTS

| | | | |
|---|---|---|---|
| GB | 2258675 | A | 2/1993 |
| GB | 2409868 | A | 7/2005 |

(Continued)

*Primary Examiner* — Matthew Buck

(74) *Attorney, Agent, or Firm* — Gifford, Krass, Sprinkle, Anderson & Citkowski, P.C.

(57) ABSTRACT

A tensioning apparatus for applying a substantially constant tension to a workover riser (12) includes a first portion (40) adapted to be coupled to a workover riser, a second portion (44) adapted to be coupled to a marine riser (14) and tensioning means (46) for providing relative movement between the first portion and the second portion to, in use, tension the workover riser.

19 Claims, 10 Drawing Sheets

(56) References Cited

U.S. PATENT DOCUMENTS

| | | | | |
|---|---|---|---|---|
| 6,148,922 | A * | 11/2000 | Vatne | 166/367 |
| 6,173,781 | B1 * | 1/2001 | Milne et al. | 166/355 |
| 6,213,206 | B1 * | 4/2001 | Bakke | 166/242.7 |
| 6,231,265 | B1 * | 5/2001 | Rytlewski et al. | 403/322.1 |
| 6,273,193 | B1 * | 8/2001 | Hermann et al. | 166/359 |
| 6,408,946 | B1 * | 6/2002 | Marshall et al. | 166/317 |
| 6,425,443 | B1 * | 7/2002 | Hill et al. | 166/377 |
| 6,450,541 | B1 * | 9/2002 | Bakke | 285/2 |
| 6,516,887 | B2 * | 2/2003 | Nguyen et al. | 166/348 |
| 7,100,696 | B2 * | 9/2006 | Marshall | 166/377 |
| 7,114,573 | B2 * | 10/2006 | Hirth et al. | 166/382 |
| 7,174,963 | B2 * | 2/2007 | Bertelsen | 166/376 |
| 7,188,677 | B2 * | 3/2007 | Moe | 166/355 |
| 7,219,739 | B2 * | 5/2007 | Robichaux | 166/355 |
| 7,237,613 | B2 * | 7/2007 | Radi et al. | 166/359 |
| 7,314,087 | B2 * | 1/2008 | Robichaux | 166/355 |
| 7,334,967 | B2 * | 2/2008 | Blakseth et al. | 405/224.2 |
| 7,373,985 | B2 * | 5/2008 | Moe | 166/355 |
| 7,438,505 | B2 * | 10/2008 | Olsen et al. | 405/224.4 |
| 7,866,399 | B2 * | 1/2011 | Kozicz et al. | 166/367 |
| 8,727,014 | B2 * | 5/2014 | Edwards | 166/350 |
| 2006/0280560 | A1 * | 12/2006 | Ellis et al. | 405/223.1 |
| 2007/0084606 | A1 * | 4/2007 | Ponville | 166/355 |

FOREIGN PATENT DOCUMENTS

| | | | |
|---|---|---|---|
| WO | 0024998 | A1 | 5/2000 |
| WO | 03067023 | A1 | 8/2003 |
| WO | 2005100737 | A1 | 10/2005 |

* cited by examiner

WORKOVER RISER COMPENSATOR SYSTEM

CROSS-REFERENCE TO RELATED APPLICATIONS

This application is a continuation of U.S. patent application Ser. No. 13/456,376 filed Apr. 26, 2012, which is a continuation of U.S. patent application Ser. No. 12/307,379 filed Jan. 5, 2009, which is the U.S. national phase of PCT/GB07/002516 filed Jul. 5, 2007, which claims priority of Great Britain Patent Application 0613393.8 filed Jul. 6, 2006.

FIELD OF THE INVENTION

The present invention relates to a compensator system and a weak link system for a workover riser.

BACKGROUND OF THE INVENTION

Marine risers are widely used in the process of hydrocarbon extraction from subsea oil wells. The marine riser extends from a BOP stack located on the seabed up to an oil vessel located on the surface. During intervention operations a length of tubing called a workover riser is located within the marine riser. The workover riser passes through the BOP stack via a well control device, normally consisting of dual well isolation valve and a disconnect system, and subsequently via the production tubing down to the formation. Completion and intervention activities within the well bore are performed from the surface vessel via the workover riser.

Conventionally, a compensator system is provided on the vessel. The compensator system has two main functions. The first is to apply a force to the workover riser to maintain the workover riser in a substantially constant tension.

As the prevailing sea conditions can cause the vessel to oscillate vertically with respect to the seabed, the compensator system's second function is to compensate for the vertical oscillation to ensure the tension in the workover riser remains substantially constant. If the compensator system does not compensate adequately for the movement of the vessel due to, for example, a system lock-up, then as the vessel moves vertically away from the seabed, the workover riser can become over-tensioned possibly inducing tensile failure. Similarly, as the vessel moves towards the seabed, the workover riser will enter a compressive state possibility inducing compressive failure.

Under flat sea conditions, the upper end of the workover riser is located at a sufficient height above the vessel deck to ensure that, in rough seas when the vessel is at the maximum extent of its vertical movement, the upper end of the workover riser is still maintained above the level of the vessel deck.

As conventional compensation systems support the workover riser from above they have to, therefore, be mounted in a derrick high above the surface of the deck. If it is necessary to perform an operation downhole requiring, for example, the introduction of tools into the workover riser, an operator may have to be lifted up to the upper end of the riser in an operation called man-riding. When an operator is man-riding he is effectively suspended above the deck and is exposed to potential falling hazards or impact injuries, particularly in strong winds. In this situation, the operator is also exposed to the additional danger of becoming snagged or trapped in the surface well control equipment as it oscillates in relationship to the vessel.

If the workover riser suffers tensile failure, both considerable HSE risks and severe environmental damage can occur when the contents of the workover riser are released.

It is also known to provide weak link systems which permit separation of the vessel from the workover riser in the event of failure to minimise damage to equipment. Conventional weak link systems do not, however, prevent the contents of the workover riser being released.

Furthermore, when the workover riser fails it is desirable to isolate and seal the well. In the event of workover riser failure, the BOP rams generally have to cut through the workover riser, a situation which is not ideal as it is preferable for the rams to be unobstructed as they close.

SUMMARY OF THE INVENTION

An object of at least one embodiment of the present invention is to obviate or mitigate at least one of the disadvantages of the aforementioned compensation systems or weak link systems.

This is achieved by providing a tensioning apparatus which co-operates with the marine riser to tension the workover riser, the tensioning of the workover riser, therefore, taking place in the marine riser rather than on the vessel.

A length variation apparatus is also provided which provides for a variation in length of the workover riser to maintain an upper end of the workover riser in a substantially fixed location with respect to the deck of the vessel.

A latch is also provided which permits separation of the entire workover riser from the BOP. The latch is located between the workover riser retainer valve, which is provided towards the bottom of the workover riser, and the BOP. Upon separation of the workover riser from the BOP, the retainer valve can be closed to retain the contents of the workover riser within the workover riser.

According to a first aspect of the present invention there is provided a tensioning apparatus for applying a substantially constant tension to a workover riser, the tensioning apparatus including:

a first portion adapted to be coupled to a workover riser;

a second portion adapted to be coupled to a marine riser; and tensioning means for providing relative movement between the first portion and the second portion to, in use, tension the workover riser.

Providing tensioning apparatus, which tensions the workover riser by relative movement of a first portion coupled to the workover riser with respect to a second portion coupled to the marine riser, means that the workover riser can be tensioned from a location below, and hence independently from, the vessel. Such a tensioning apparatus, therefore, is not subject to the compressive or tensile loads induced by the movement of the vessel and is subsequently much less likely to fail.

Preferably, the tensioning apparatus includes an apparatus body, the apparatus first portion being integral with the apparatus body.

Preferably, the tensioning apparatus body defines a body throughbore.

Preferably, when the apparatus body is connected to a workover riser, the body throughbore is in fluid communication with the workover riser.

Preferably, in use, a lower end of the apparatus body is adapted to be coupled to a lower section of a workover riser. The lower section of the workover riser extends from the tensioning apparatus down to the BOP.

Preferably, also in use, an upper end of the apparatus body is adapted to be coupled to an upper section of a workover riser. The upper section of the workover riser extends from the tensioning apparatus up to the deck of the vessel.

Preferably, the workover riser upper section includes an apparatus for providing variation in length of the workover riser.

Preferably, the second portion is adapted to engage a no-go defined by the marine riser.

Preferably, the no-go is a shoulder.

Preferably, the second portion is moveable, in use, between a run-in configuration in which the second portion will not engage the shoulder and an activated configuration in which the second portion engages the marine riser shoulder.

Preferably, the second portion is radially moveable between the run-in configuration and the activated configuration.

Preferably, the second portion is radially movable by radial expansion.

Preferably, once radially expanded, the second portion engages the marine riser shoulder by landing on the shoulder.

Preferably, the second portion comprises at least one radially moveable element.

Preferably, the second portion comprises a plurality of radially movable elements.

Preferably, the radially moveable elements in the run-in configuration define an annular collar.

Preferably, the annular collar is mounted around the apparatus body.

Preferably, in the activated configuration, the at least one radially moveable element is displaced radially away from the apparatus body.

Preferably, the tensioning means includes an expansion surface adapted to expand the at least one radially moveable element to the activated configuration.

Preferably, the expansion surface engages a complementary surface defined by the at least one radially moveable element.

Preferably, the expansion surface is adapted to move axially with respect to the apparatus body.

Preferably, the expansion surface is adapted to be moved axially with respect to the apparatus body by hydraulic pressure.

Preferably, the second portion is releasably axially fixed with respect to the first portion.

Preferably, the second portion is releasably fixed to the apparatus body.

Preferably, the second portion is releasably fixed to the apparatus body by shear screws.

Alternatively, the second portion is releasably fixed by any suitable restraining means.

According to a second aspect of the present invention there is provided a length variation apparatus for permitting variation in the overall length of a workover riser, the length variation apparatus including:

a lower body adapted to be coupled to a lower section of a workover riser; and an upper body adapted to be coupled to an upper section of a workover riser;

wherein the upper body is adapted to move relative to the lower body to permit variation in the overall length of the workover riser.

Providing a length variation apparatus which permits the overall length of a workover riser to vary means that, in use, the upper end of the workover riser upper section can be fixed relative to the deck of a vessel, the apparatus providing variation in the overall length of the workover riser as the vessel rises and falls due to the prevailing sea conditions.

Preferably, the length varying apparatus defines a throughbore to provide fluid communication, in use, between the lower workover riser section and the upper workover riser section.

Preferably, the length variation apparatus lower body is adapted to be coupled to a lower workover riser section including tensioning apparatus for applying a substantially constant tension to the lower workover riser section.

Preferably, the length variation apparatus is adapted to be coupled to the tensioning apparatus.

Preferably, the upper and lower bodies are in a telescopic relationship with respect to each other.

Preferably, one of the upper or lower bodies is adapted to slide within the other of the upper and lower bodies.

Preferably, the upper body is adapted to slide within the lower body.

Preferably, the length variation apparatus further comprises guide means to control the relative movement of the upper and lower bodies.

Preferably, the guide means comprises at least one piston attached to the upper body.

Preferably, the guide means comprises a plurality of pistons.

Preferably, the/each piston is adapted to reciprocate within a piston chamber defined by the lower body.

Preferably, as the upper body moves relative to the lower body, each piston moves within its respective piston chamber.

Preferably, the/each piston chamber is in fluid communication with the apparatus throughbore.

Preferably, at least one vent is provided to provide fluid communication between the/each piston chamber and the apparatus throughbore. Providing a vent between each piston chamber and the apparatus throughbore maintains a constant apparatus volume and keeps the apparatus pressure balanced. This is achieved by the movement of fluid stored in the position chambers into the apparatus throughbore as the apparatus increases in length and the movement of fluid from the apparatus throughbore into the piston chambers as the apparatus decreases in length.

Preferably, the apparatus further comprises latching means, the latching means adapted to fix the upper body relative to the lower body.

Preferably, the latching means is adapted to fix the upper body relative to the lower body in a mid-stroke position.

Alternatively or additionally, the latching means is adapted to fix the upper body relative to the lower body in a fully retracted position.

Preferably, the latching means can be manually activated to fix the upper body relative to the lower body.

In one embodiment, the latching means is adapted to fix the upper body relative to the lower body in any position.

Preferably, the latching means applies a latching force to fix the upper body relative to the lower body.

Preferably, a tensile or compressive load greater than the latching force releases the latching means enabling the upper body to move relative to the lower body. The latching force is selected to be below the tensile and compressive load capabilities of the workover riser.

Preferably, the stroke of the length variation apparatus is approximately 10 meters.

According to a third aspect of the present invention there is provided a latch for separating a workover riser from a sub sea isolation system in the event of over-tensioning of the workover riser the latch including:

a first portion adapted to be connected to a sub sea isolation system;

a second portion adapted to be connected to a workover riser, the second portion being moveable relative to the first portion;

latching means releasably connecting the first portion to the sub sea isolation system;

wherein, in use, when the tension in the workover riser exceeds a pre-determined value, relative movement of the second portion with respect to the first portion releases the latching means from the sub sea isolation system such that the workover riser is separated from the sub sea isolation system.

This aspect of the present invention provides a latch which permits separation of the entire workover riser from the sub sea isolation system and subsequently the drilling BOP. This is advantageous because a retainer valve, which can be closed to retain the contents of the workover riser within the workover riser, is provided towards the bottom of the workover riser.

Preferably, the second portion moves relative to the first portion at a pre-determined tension which is selected, in use, to ensure that riser tensioning device will raise the workover riser clear of the BOP rams, permitting unobstructed closure of the rams.

Preferably, the latch is adapted to receive a sub sea isolation system control means.

Preferably, the sub sea isolation system control means is a control line.

Preferably, the latch includes a control passage adapted to provide communication between the control line and the sub sea isolation system.

Preferably, a first section of the control passage is defined by the first latch portion, and a second section of the control passage is defined by the second latch portion.

Preferably, when the second latch portion moves relative to the first latch portion, the control passage is broken, causing, in use, the sub sea isolation system to close.

Preferably, the control passage is a hydraulic line.

Preferably, the control passage is a hydraulic conduit providing, in use, fluid communication between the sub sea isolation system hydraulic control line and the sub sea isolation system. In use, breaking the fluid communication between the hydraulic control line and the sub sea isolation system will result in a hydraulic pressure drop at the sub sea isolation system, causing the sub sea isolation system to close and isolate the well from the external environment.

Preferably, in use, when the workover riser separates from the sub sea isolation system, a workover riser retainer valve closes. Releasing the workover riser separates from the sub sea isolation system isolates a fluid communication path between the retainer valve hydraulic control line and the retainer valve. This isolation results in a hydraulic pressure drop at the retainer valve, causing the retainer valve to close and isolate the workover riser contents from the external environment.

Preferably, the latch further includes compensation means for compensating for the pressure end load force applied to the workover riser by well pressure. The pressure end load force induces significant end load that reduces the tension which can be applied from surface to the workover riser before tensile failure occurs.

Preferably, the compensation means includes a piston and a piston chamber, the piston being adapted to reciprocate within the piston chamber.

Preferably, the piston chamber is adapted to receive a fluid.

Preferably, the piston chamber is adapted to receive fluid, in use, from the workover riser.

Preferably, the piston chamber is adapted to receive a fluid at well pressure.

Preferably, in use, the introduction of fluid into the piston chamber results in an increase in pressure in the piston chamber.

Preferably, an increase in piston chamber pressure acts on the piston.

Preferably, the pressure applied to the piston is, in turn, applied by the piston, in use, to the workover riser as a counter force, the counter force opposing the end load force.

Preferably, the counter force applied, in use, by the piston to the workover riser is proportional to the end load force.

Preferably, the area of the compensation piston is between 75-95% of the area of the latch.

According to a fourth aspect of the present invention there is provided a compensator system for applying a substantially constant tension to a workover riser and permitting variation in the overall length of the workover riser, the system including:

a lower body having a first portion adapted to be coupled to a lower section of a workover riser, and a second portion adapted to be coupled to a marine riser, tensioning means for providing relative movement between the first portion and the second portion to tension the lower workover riser section; and an upper body adapted to be connected to an upper section of the workover riser, the upper body being adapted to move relative to the lower body to permit variation in the overall length of the workover riser.

According to a fifth aspect of the present invention there is provided a method of tensioning a workover riser, the method including the steps of:

coupling a first portion of a tensioning apparatus with a workover riser;

coupling a second portion of the tensioning apparatus with a marine riser; moving the second portion relative to the first portion to tension the workover riser.

According to a sixth aspect of the present invention there is provided a method of permitting variation in length of a workover riser, the method including the steps of:

coupling a lower body to a lower section of a workover riser;

coupling an upper body to an upper section of a workover riser;

permitting relative movement between the upper and lower bodies to provide variation in the overall length of the workover riser.

According to a seventh aspect of the present invention there is provided a riser assembly including:

a marine riser;

a workover riser;

a compensator system including:

a lower body having a first portion adapted to be coupled to a lower section of the workover riser, and a second portion adapted to be coupled to the marine riser, tensioning means for providing relative movement between the first portion and the second portion to tension the lower workover riser section; and an upper body adapted to be connected to an upper section of the workover riser, the upper body being adapted to move relative to the lower body to permit variation in the overall length of the workover riser; and a latch for separating the workover riser from a sub sea isolation system in the event of over-tensioning of the workover riser.

Preferably, the latch includes:

a first portion adapted to be connected to a sub sea isolation system;

a second portion adapted to be connected to a workover riser, the second portion being moveable relative to the first portion;

latching means releasably connecting the first portion to the sub sea isolation system;

wherein, in use, when the tension in the workover riser exceeds a pre-determined value, relative movement of the second portion with respect to the first portion releases the latching means from the sub sea isolation system such that the workover riser is separated from the sub sea isolation system.

According to an eighth aspect of the present invention there is provided a riser assembly including:

a marine riser;

a workover riser; and a length variation apparatus, the length variation apparatus including:

a lower body adapted to be coupled to a lower section of the workover riser; and an upper body adapted to be coupled to an upper section of the workover riser;

wherein the upper body is adapted to move relative to the lower body to permit variation in the overall length of the workover riser.

According to a ninth aspect of the present invention there is provided a riser assembly including:

a marine riser;

a workover riser; and a tensioning apparatus, the tensioning apparatus including:

a first portion adapted to be coupled to the workover riser;

a second portion adapted to be coupled to the marine riser; and tensioning means for providing relative movement between the first portion and the second portion to, in use, tension the workover riser.

According to a tenth aspect of the present invention there is provided a riser assembly including:

a marine riser;

a workover riser; and a latch for separating the workover riser from a sub sea isolation system in the event of over-tensioning of the workover riser the latch including:

a first portion adapted to be connected to a sub sea isolation system;

a second portion adapted to be connected to the workover riser, the second portion being moveable relative to the first portion;

latching means releasably connecting the first portion to the sub sea isolation system;

wherein, in use, when the tension in the workover riser exceeds a pre-determined value, relative movement of the second portion with respect to the first portion releases the latching means from the sub sea isolation system such that the workover riser is separated from the sub sea isolation system.

BRIEF DESCRIPTION OF THE DRAWINGS

These and other aspects of the present invention will become apparent from the following description when taken in combination with the accompanying drawings in which.

DETAILED DESCRIPTION OF THE PREFERRED EMBODIMENTS

Figure 1:
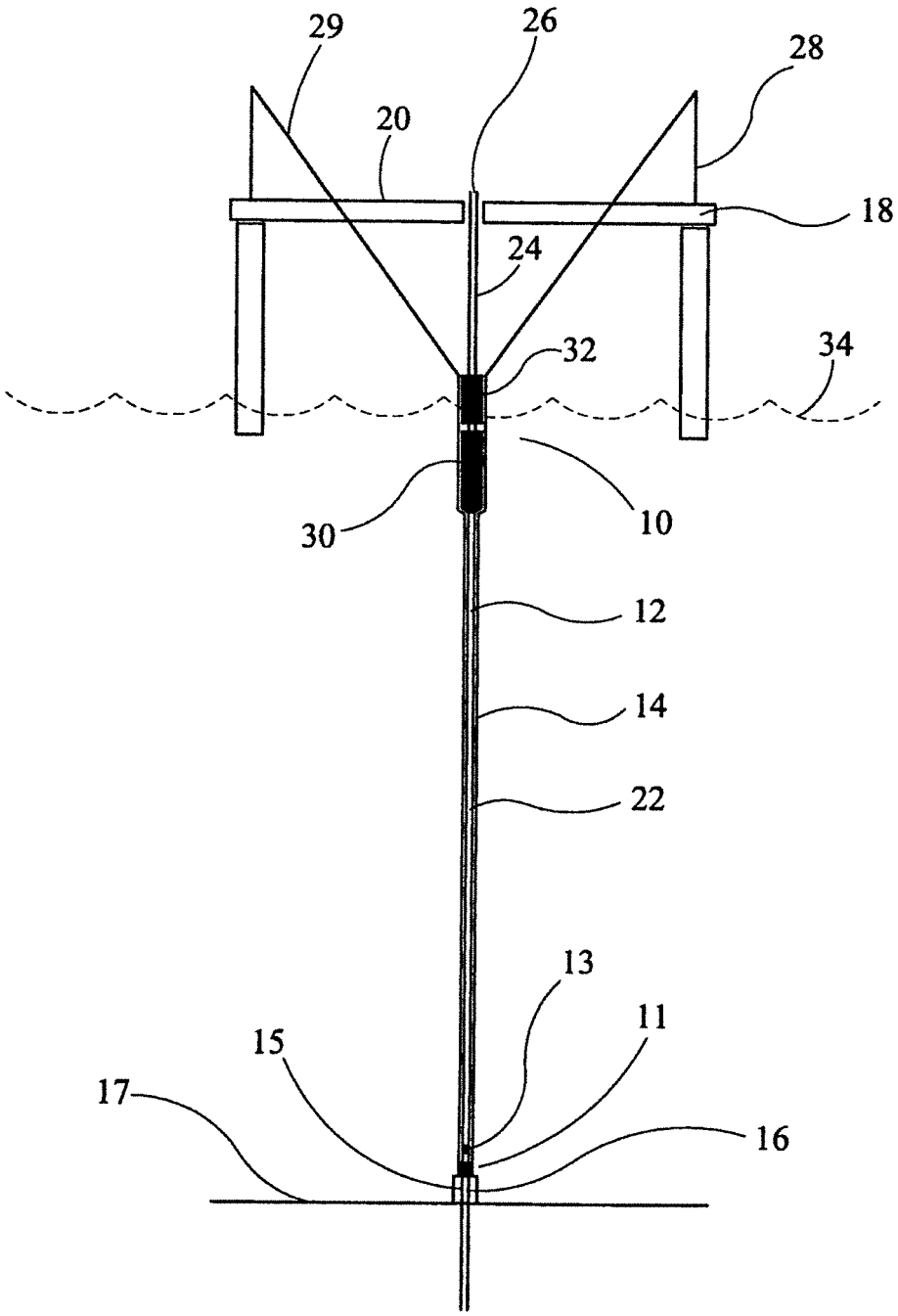
FIG. 1 is a schematic view of a compensator and weak link system for applying a substantially constant tension to a workover riser and permitting variation in the overall length of the workover riser in accordance with a preferred embodiment of the present invention.

Referring firstly to FIG. 1, there is shown a schematic view of a compensator system, generally indicated by reference numeral 10, for applying a substantially constant tension to a workover riser 12, permitting variation in the overall length of the workover riser 12, and a weak link system 11, for permitting separation of the workover riser 12 from a sub sea isolation system 16 in the event of over tensioning of the workover riser 12 in accordance with a preferred embodiment of the present invention.

The workover riser 12 is shown running through a marine riser 14 from a BOP stack 15 on the seabed 17 up to the deck 18 of a vessel 20. The workover riser comprises a lower section 22 and an upper section 24, the upper section 24 having an upper end 26 adjacent the vessel deck 18. The lower workover riser section 24 10 includes a retainer valve 13. The marine riser 14 is supported by a marine riser tensioning system 28 attached to the marine riser 14 by tensioning cables 29.

The compensator system 10 includes a tensioning apparatus 30, for tensioning the workover riser 12 and which will be described in detail in connection with FIGS. 2 to 7. The compensator system 10 also includes a length variation apparatus 32 which permits variation in the overall length of the workover riser 12 so that the workover riser upper end 26 is maintained in a fixed position with relative to the vessel deck 18 as the vessel 20 moves up and down in response to the prevailing sea conditions 34. The length variation apparatus 32 will be described later with reference to FIGS. 8 to 11. The weak link system comprises a latch 11, which will be discussed in connection with FIGS. 12 to 14.

Figure 2:
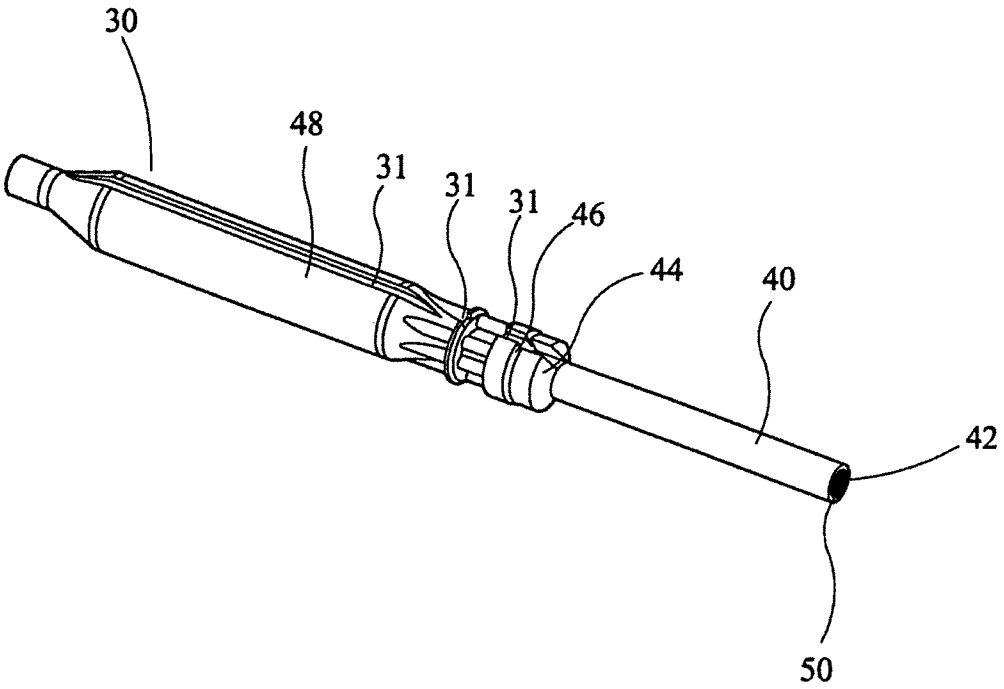
FIG. 2 is a perspective view of a tensioning apparatus of the compensator system of FIG. 1.

Referring now to FIG. 2, there is shown a perspective view of the tensioning apparatus 30 of the tensioning system 10 of FIG. 1.

The tensioning apparatus 30 comprises a first portion 40 adapted to be connected to the workover riser 12, a second portion 44 adapted to be connected to the marine riser 14 and tensioning means 46 for providing relative movement between the first portion 40 and the second portion 44 to tension the workover riser 12.

The first portion 40 is the lower end of a tensioning apparatus body 48. The apparatus body 48 defines a throughbore 50 providing fluid communication from the workover riser 12 through the tensioning apparatus 30. The first portion is adapted to be connected to the workover riser lower section 22 by means of a thread 42.

It will be noted that the apparatus body 48 and the tensioning means 46 define a first umbilical groove 31. The groove 31 is to permit an umbilical to be run from the vessel 20 past the tensioning apparatus 30 to a downhole location. A second umbilical groove (not visible), to accommodate a second umbilical, is located diametrically opposite the first groove 31.

Figure 3:
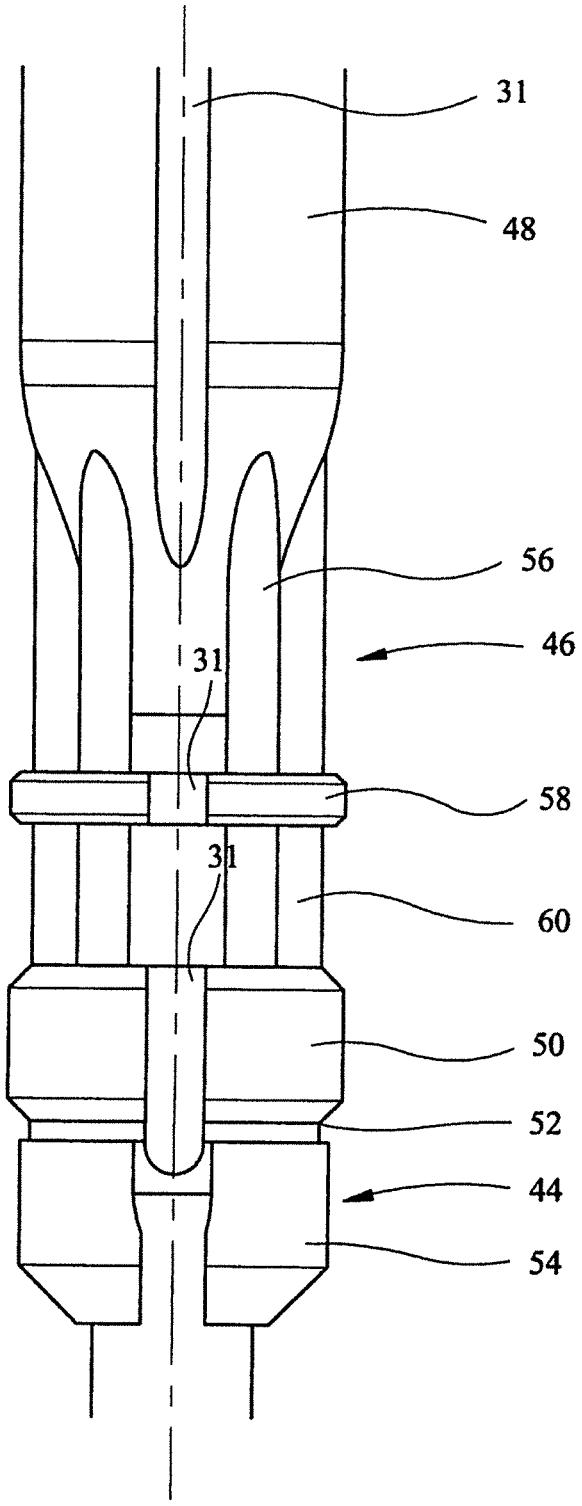
FIG. 3 is an enlarged side view of part of the tensioning apparatus of FIG. 2.

The tensioning means 46 and the apparatus second portion 44 are more clearly displayed in FIG. 3, which is an enlarged side view of part of the tensioning apparatus 30 of FIG. 2.

The tensioning apparatus second portion 44 comprises six radially moveable elements 54. The radially moveable elements 54 are moveable between a run-in configuration (shown in FIG. 2) and an activated configuration in which the radially moveable elements 54 are displaced radially away from the apparatus body 48. The elements 54 are attached to a collet ring 58 by four braces 60. The collet ring 58 prevents axial movement of the elements 54 during the displacement of the elements 54 from the run-in configuration to the activated configuration.

The tensioning means 46 comprises an axially moveable mandrel 50 having an expansion surface 52. To radially displace the moveable elements 54 away from the apparatus body 48, the mandrel 50 is driven axially towards the elements 54 by a eight pistons 56 circumferentially disposed around the apparatus body 48.

Figure 4:
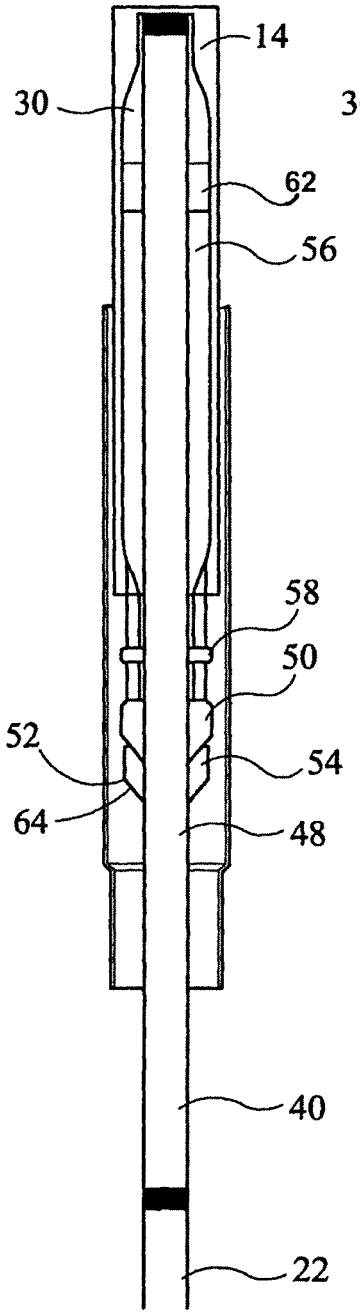
FIG. 4 is a longitudinal sectional view of the tensioning apparatus of FIG. 2 in a run-in configuration in a marine riser.
Figure 5:
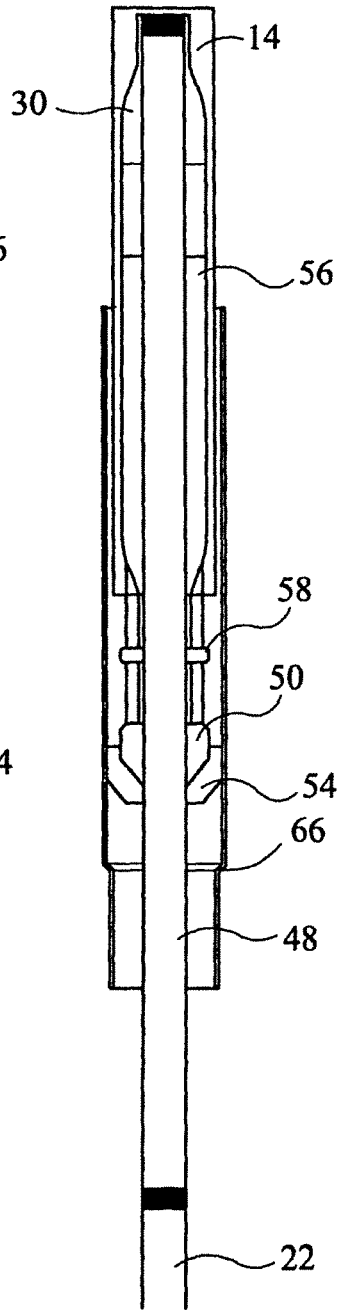
FIG. 5 is a longitudinal sectional view of the tensioning apparatus of FIG. 2 in an activated configuration in the marine riser.
Figure 6:
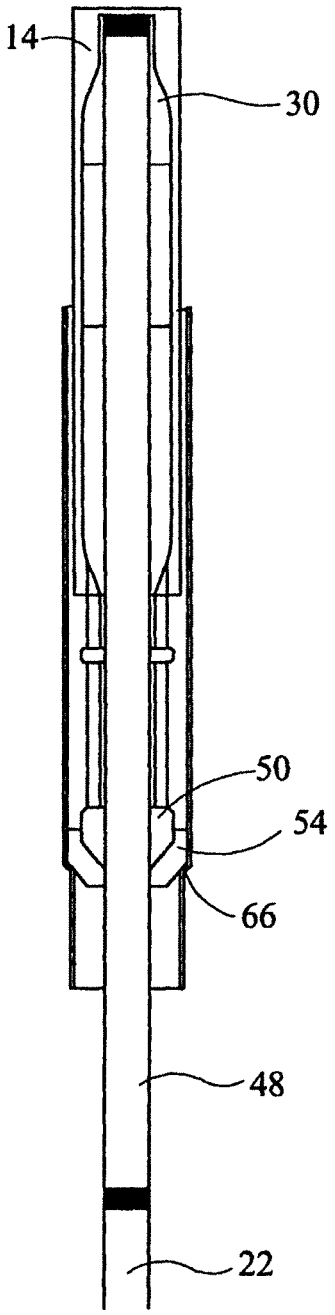
FIG. 6 is a longitudinal sectional view of the tensioning apparatus of FIG. 2 shown coupled with a marine riser shoulder.

This procedure can be better understood with reference to FIGS. 4 to 6, a series of section views showing the tensioning of a workover riser 12 within a marine riser 14.

Referring first to FIG. 4, this shows a longitudinal sectional view of the tensioning apparatus 30 of FIG. 2 in a run-in configuration in the marine riser 14.

The tensioning apparatus first portion 40 has been attached to the workover riser lower section 22 and the radially moveable elements 54 are retracted against the apparatus body 48.

As hydraulic fluid is introduced into each of the pistons chambers 62 which receive one of the eight pistons 56, the pistons 56 move together, axially downwards, urging the mandrel 50 towards the radially moveable elements 54. Once the mandrel 50 reaches the elements 54, the mandrel expansion surface 52 engages a rear surface 64 of each element 54.

As the elements 54 are prevented from axial movement by the collet ring 58, continued movement of the mandrel 50 is translated to radially move elements 54 to the activated configuration shown in FIG. 5, a longitudinal sectional view of the tensioning apparatus 30 of FIG. 2 in a activated configuration in the marine riser 14.

In FIG. 5 the elements 54 have been fully radially expanded. The application of continued hydraulic pressure on the pistons 56 increases the pressure on the collet ring 58 which axially fixes the elements 54 with respect to the apparatus body 48 by means of shear screws (not shown).

At a pre-determined force, the shear screws shear and the elements 54 and the mandrel 50 move axially down the apparatus body 48 towards a marine riser shoulder 66.

Referring now to FIG. 6, which shows a longitudinal sectional view of the tensioning apparatus of FIG. 2 shown coupled with the marine riser shoulder 66, the expanded elements 54 and mandrel 50 have axially moved down the apparatus body 48 until the expanded elements 54 have engaged the marine riser shoulder 66. Further axial movement of the elements 54 is prevented by the shoulder 66.

As further axial movement of the expanded elements 54 is prevented, continued application of hydraulic pressure to the pistons 56 generates a pull on the workover riser lower section 22, increasing the tension on the lower workover riser section 22.

Figure 7:
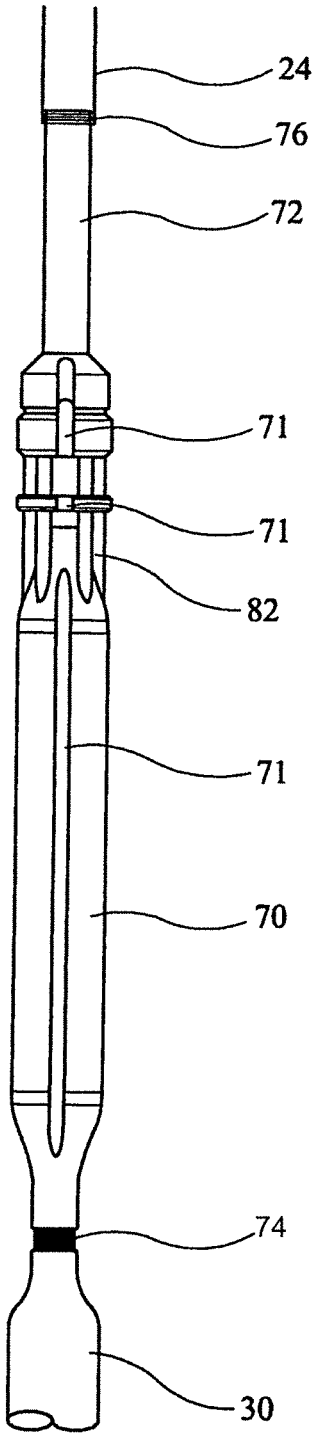
FIG. 7 is a side view of a length variation apparatus of the compensator system of FIG. 1.

Referring now to FIG. 7, there is shown a side view of the length variation apparatus 32 of the system 10 of FIG. 1.

The length variation apparatus 32 comprises a lower body 70 coupled to the tensioning apparatus 30, which is in turn coupled to the lower workover riser section (not shown), and an upper body 72 coupled to an upper workover riser section 24.

The length variation apparatus 32 is coupled to the tensioning apparatus 30 and the upper riser section 24 by first and second threaded connections 74, 76 respectively.

The length variation apparatus 32 defines a first umbilical groove 71. The first umbilical groove 71 is arranged such that, when the length variation apparatus 32 is coupled to the tensioning apparatus 30, the first tensioning apparatus umbilical groove 31 is aligned with the first length variation apparatus umbilical groove 71, permitting an umbilical to be run from the vessel 20 to a downhole location past the compensator system 10.

A second length variation apparatus umbilical groove 73 (shown later on FIG. 9) is located diametrically opposite the first groove 71.

The lower and upper bodies 70, 72 are arranged telescopically such that relative movement is possible between the bodies 70, 72 to permit variation in the overall length of the workover riser 12. The length variation apparatus 32 also includes six guide pistons 82 for controlling the relative movement of the bodies 70, 72.

Figure 8:
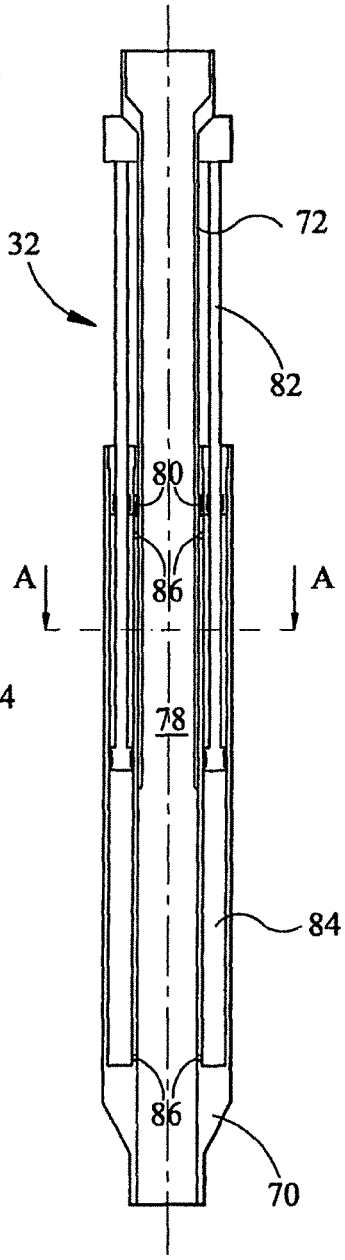
FIG. 8 is a longitudinal sectional view of the length variation apparatus of FIG. 7 in a mid-stroke configuration.

The arrangement of the bodies 70, 72 and the guide pistons 82 can be seen more clearly in FIG. 8, which shows a longitudinal sectional view of the length variation apparatus 32 of FIG. 7 in a mid-stroke configuration.

As can be seen from FIG. 8 the upper body 72 extends inside the lower body 70. The bodies 70, 72 define a throughbore 78 permitting fluid communication between the upper and lower workover riser sections 22, 24. A seal 80 is provided between the upper and lower bodies 70, 72 to maintain the integrity of the workover riser 12.

As the vessel 20 moves under the influence of the prevailing sea conditions, the length variation apparatus 32 contracts or extends about the mid stroke configuration shown in FIG. 8. As the force applied by the vessel 20 on the upper workover riser section 24 is taken up by the length variation apparatus 32, vessel movement does not effect the tension in the lower workover riser section 22. Additionally, use of the length variation apparatus 32 permits the upper end 26 of the upper workover riser section 24 (shown in FIG. 1) to be fixed relative to the vessel deck 18 with the result that the upper end 26 of the riser 12 can be at deck level rather than raised above the deck level.

Movement between the extended and contracted positions is controlled by means of the pistons 82 attached to the upper body 72. Each of the six pistons 82 reciprocates within a piston chamber 84 defined by the lower body 70. Each piston 82 within the piston chamber 84 acts as a guide. Each piston chamber 84 includes a vent 86 permitting fluid passing through the workover riser 12 and the length variation apparatus 32 to enter each piston chamber 84. The total cross sectional area of the six piston chambers 84 equates to the cross sectional area of the length variation apparatus throughbore 78.

Consequently as the upper body 72 moves relative to the lower body 70 to extend the length variation apparatus 32, the increase in internal volume of the length variation apparatus 32, created by this extension, is compensated for by the displacement of the fluid from the piston chambers 84 through the vent 86 into the throughbore 78, thereby avoiding any piston effect. Similarly as the upper body 72 moves relative to the lower body 70 to contract the length variation apparatus 32, the decrease in internal volume of the length variation apparatus 32, created by this contraction, is compensated for by the displacement of the fluid from throughbore 78 to the piston chambers 84 through the vent 86. This facility enables the length variation apparatus 32 to reciprocate whilst maintaining a constant volume and pressure.

Figure 9:
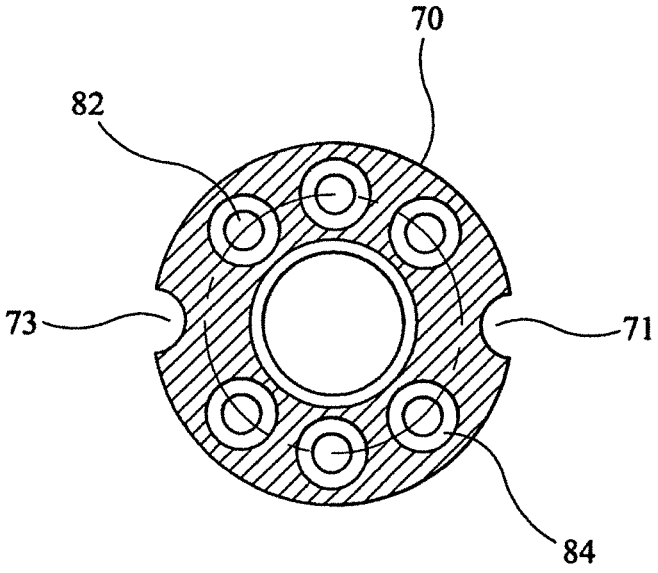
FIG. 9 is a cross section through line A-A on FIG. 8.

FIG. 9 is a cross section through line A-A on FIG. 8 showing the lower body 70, the first and second umbilical grooves 71, 73, the pistons 82 and their respective piston chambers 84.

Figure 11:
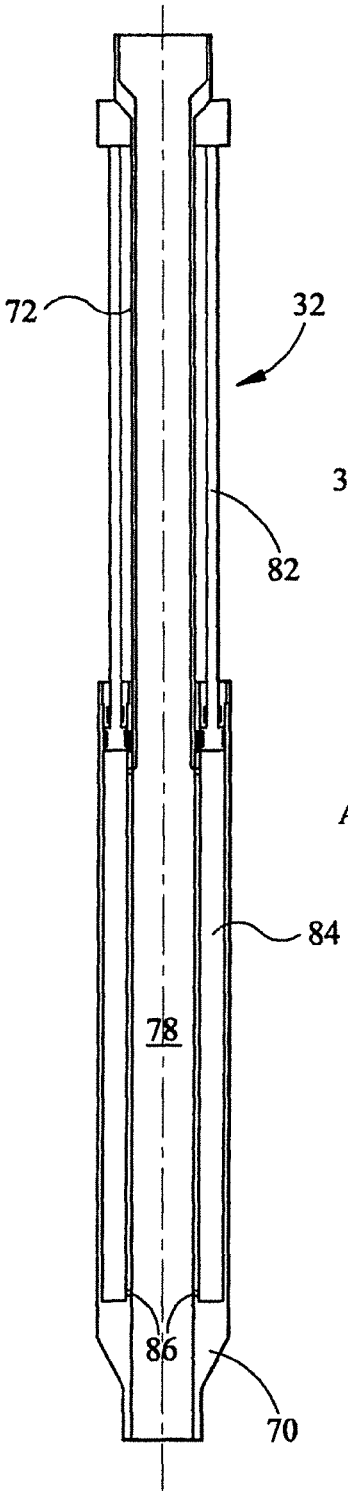
FIG. 11 is a longitudinal sectional view of the length variation apparatus of FIG. 7 in a contracted configuration.
Figure 10:
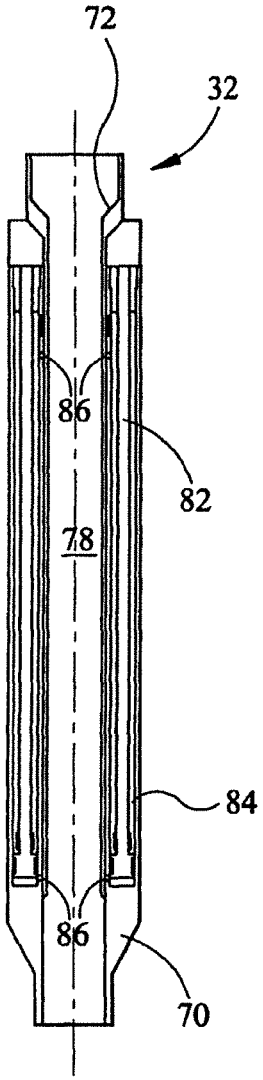
FIG. 10 is a longitudinal sectional view of the length variation apparatus of FIG. 7 in an extended configuration.

FIG. 10 is a longitudinal sectional view showing the length variation apparatus 32 in the extended configuration and FIG. 11 is a longitudinal sectional view showing the length variation apparatus 32 in the contracted configuration.

Figure 12:
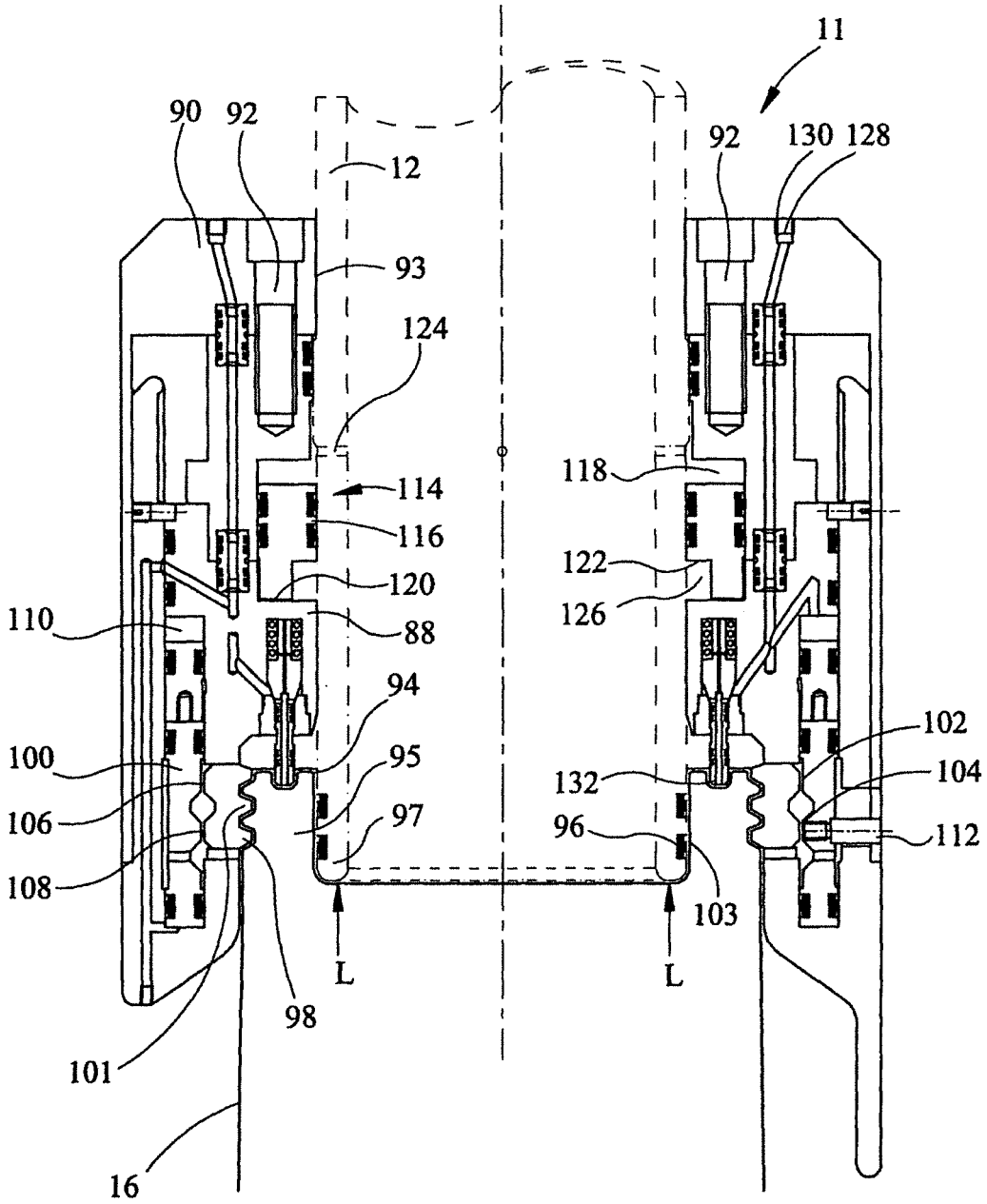
FIG. 12 is a longitudinal sectional view of the latch of FIG. 1 in a latched configuration.

Referring now to FIG. 12, there is shown a longitudinal sectional view of the latch 11 of FIG. 1 in a latched configuration.

The latch 11 comprises a first portion 88 and a second portion 90. The second portion 90 is connected to the workover riser 12 (shown in broken outline) by a threaded connection 93. The second portion 90 is releasably connected to the first portion 88 by means of eight shear studs 92.

The latch 11 and the bottom 97 of the workover riser 12 define an annular void 94 adapted to receive the upper neck of the sub sea isolation system 16. The latch first portion 88 is connected to the sub sea isolation system neck 95 by a plurality of latch dogs 98 which releasably engage complementary recesses in the external surface 101 of the isolation system neck 95. The workover riser 12 is provided with seals 96 which seal against the internal surface 103 of the isolation system neck 95.

The latch 11 further includes a restraining piston 100. The restraining piston 100 includes first and second surfaces 102, 104 which engage complementary surfaces 106, 108 on the latch dogs 98. The restraining piston 100 is fixed to the second portion 90 by a number of pins 112, such that movement of the second portion 90 with respect to the first portion 88 results in movement of each restraining piston 100 within a piston chamber 110.

An end load L is applied to the workover riser 12 by well pressure, as shown on FIG. 12. This end load L adds to the tension in the workover riser 12 and can reduce the allowable level of tension the workover riser 12 can withstand prior to failure. The end load L is counteracted by means of a counter force system 114.

The counter force system 114 comprises a counter force piston 116 which can reciprocate within a counter force piston chamber 118. The counter force piston 116 has a first lower surface 120 and a second lower surface 122 adapted to apply forces to the first latch portion 88 and a workover riser upset 126 respectively. The workover riser upset 126 extends from the workover riser 12 into the piston chamber 118. The force is generated by an increase in pressure within the counter force piston chamber 118. The increase in pressure is provided by the pressurised fluid within the workover riser 12. The workover riser 12 includes vents 124 through which fluid can pass into the counter force piston chamber 118.

The fluid, which is at well pressure, acts on the first latch portion 88 and the workover riser 12 through the counter force piston 116. The downward force generated by the fluid in the piston chamber 118 counteracts the end load force L with the result that the end force L can be substantially counteracted increasing the tension that can be applied to the workover riser 12 from above without the workover riser 12 failing. The area of the compensation piston is 85% of the area of the latch connector. Such a ratio enables the reduction in the tensile capacity of the workover riser 12 created by pressure induced hoop stress to be countered, ensuring operation of the system and disconnect prior to riser failure The latch 11 further comprises a hydraulic passage 128. The hydraulic passage 128 is adapted to be connected at its upper end 130 to a sub sea isolation system control line (not shown) and at its lower end 132 to the sub sea isolation system 16. The purpose of this hydraulic passage 128 and the operation of the latch 11 will now be discussed in connection with FIG. 13.

Figure 13:
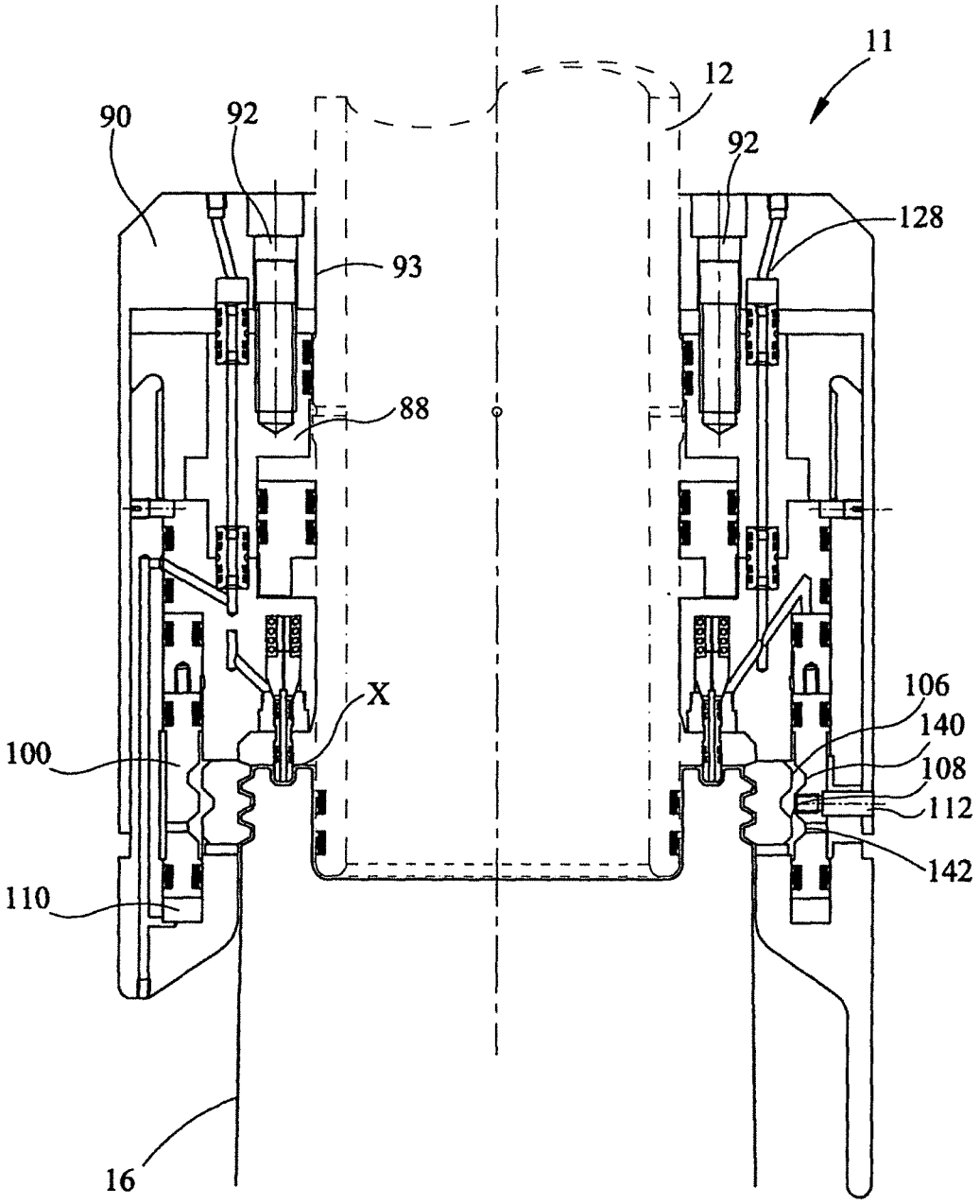
FIG. 13 is a longitudinal sectional view of the latch of FIG. 12 in a released configuration.

FIG. 13 shows a longitudinal sectional view of the latch 11 of FIG. 12 in a released configuration. A tension force has been applied to the workover riser 12 of sufficient magnitude to overcome the shear pins 92 causing them to fracture. The tension force on the workover riser 12 has pulled the second latch portion 90, via the threaded connection 93, away from the first latch portion 88. The movement of the second latch portion 90 has also moved restraining piston 100, to which is attached by pins 112, up the piston's chamber 110. The restraining piston surfaces 102, 104 have disengaged from the latch dog surfaces 106, 108 freeing the latch dogs 98 to move into piston recesses 140, 142, releasing the latch 11 from the neck 95 of the sub sea isolation system 16. This releases the workover riser 12 from the sub sea isolation system 16, the latch 11 and workover riser 12 being pulled away from the sub sea isolation system 16 by the riser tensioning device (not shown). The separation of the latch 11 from sub sea isolation system 16 breaks the hydraulic passage 128 at position "X", breaking the hydraulic connection between the sub sea isolation system control line and the sub sea isolation system 16 causing the sub sea isolation system 16 to shut.

Figure 14:
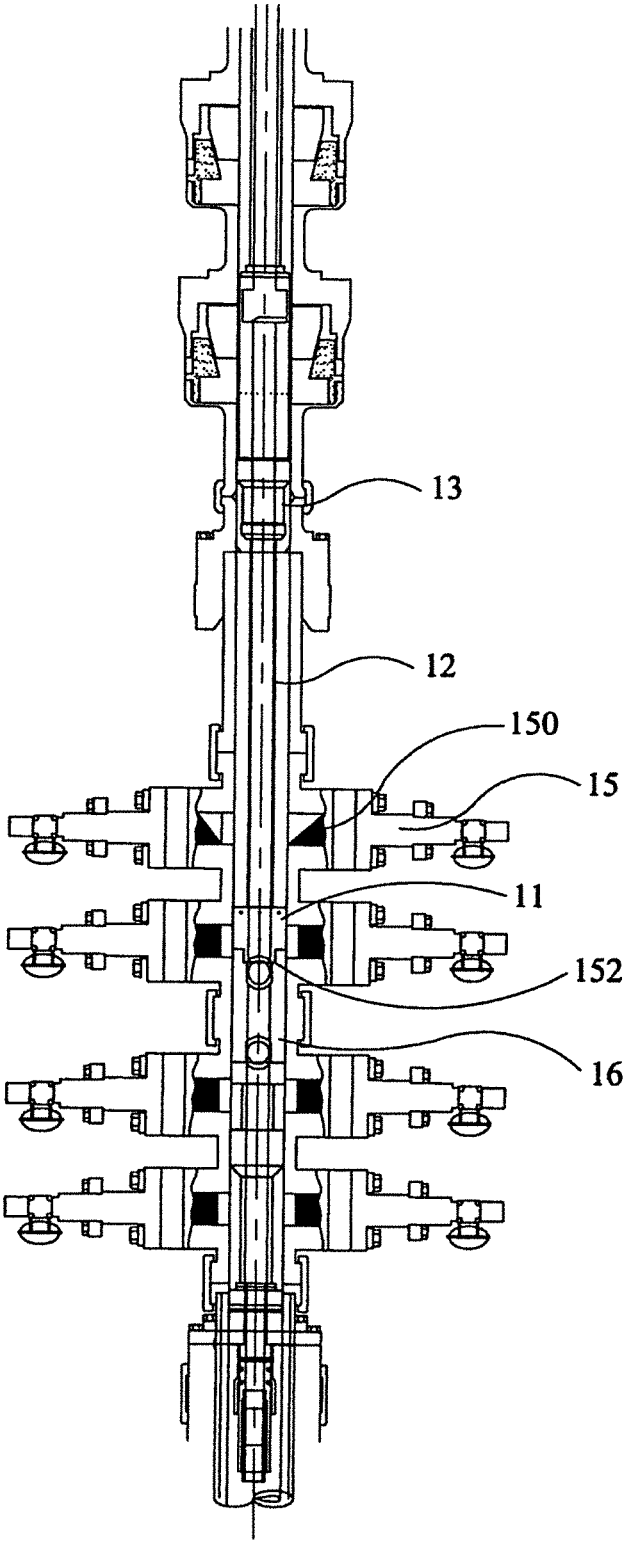
FIG. 14 is an enlarged schematic view of the latch sub sea isolation system retainer valve and the lower end of the workover riser of FIG. 1.

Referring now to FIG. 14, a schematic view of the latch 11 and sub sea isolation system 16 shown located in the BOP 15. As can be seen the latch 11 and sub sea isolation system 16 are located below the upper set of BOP shear rams 150. As the latch 11 releases from the sub sea isolation system 16, the workover riser 12 by virtue of the riser tensioning device will pull the bottom of the workover riser 152 and the latch portion 90 above the BOP rams 150 permitting unobstructed closure of the BOP 15 to seal the well. A hydraulic control line (not shown) also controls the operation of the retainer valve 13. The severance of the hydraulic passage 128, results in the loss of hydraulic pressure in the control line with the result that the retainer valve 13 also closes. Closure of the retainer valve 13 prevents the contents of the workover riser 12 spilling into the surrounding environment.

Various modifications may be made to the embodiment of the compensator system and weak link system described above without departing from the scope of the invention. For example, although shown as a complete system, the latch can be used with conventional riser tensioning systems and vice versa.

It will be appreciated that the principal advantage of the above described embodiment is that the movement of the vessel does not affect the workover riser tension. Furthermore, the upper end of the riser can be maintained at vessel deck level if desired, substantially eliminating the need for man-riding when intervention apparatus is introduced into the workover riser. Additionally, in the event that the workover riser becomes over tensioned and fails, the workover riser separates from the sub sea isolation system at a location below the retainer valve, permitting both the sub sea isolation system and the retainer valve to be closed minimising both HSE risks and environmental damage.

The invention claimed is:

1. A latch device for separating a workover riser from a sub sea isolation system in the event of over-tensioning of the workover riser, the latch device comprising:

a first latch portion adapted to be connected to the sub sea isolation system;

a second latch portion adapted to be connected to the workover riser, the second latch portion being moveable relative to the first portion from an operating configuration to a released configuration;

a latch releasably connecting the first portion to the sub sea isolation system, the latch being movable between an engaged position in which the latch is engaged with the sub sea isolation system and a disengaged position in which the latch is disengaged from the subsea isolation system;

wherein, in use, when the tension in the workover riser exceeds a pre-determined value, relative movement of the second latch portion with respect to the first latch portion from the operating configuration to a displaced configuration permits the latch to move from the engaged position to the disengaged position, releasing the latch device from the sub sea isolation system such that the workover riser is separated from the sub sea isolation system wherein the second portion moves relative to the first portion at a pre-determined tension which is selected, in use, to ensure that riser tensioning device will raise the workover riser clear of a plurality of subsea isolation system BOP rams, permitting unobstructed closure of the rams.

2. The latch device of claim 1, wherein the latch device is adapted to receive a sub sea isolation system control.

3. The latch device of claim 2, wherein the sub sea isolation system control is a control line.

4. The latch device of claim 3, wherein the latch device includes a control passage adapted to provide communication between the control line and the sub sea isolation system.

5. The latch device of claim 4, wherein a first section of the control passage is defined by the first latch portion, and a second section of the control passage is defined by the second latch portion.

6. The latch device of claim 4, wherein when the second latch portion moves relative to the first latch portion, the control passage is broken, causing, in use, the sub sea isolation system to close.

7. The latch device of claim 4, wherein the control passage is a hydraulic line.

8. The latch device of claim 4, wherein the control passage is a hydraulic conduit providing, in use, fluid communication between the sub sea isolation system hydraulic control line and the sub sea isolation system.

9. The latch device of claim 1, wherein in use, when the workover riser separates from the sub sea isolation system, a workover riser retainer valve closes.

10. The latch device of claim 1, wherein the latch device further includes a guide that compensates for the pressure end load force applied to the workover riser by well pressure.

11. A latch device for separating a workover riser from a sub sea isolation system in the event of over-tensioning of the workover riser, the latch device comprising:

a first latch portion adapted to be connected to the sub sea isolation system;

a second latch portion adapted to be connected to the workover riser, the second latch portion being moveable relative to the first portion from an operating configuration to a released configuration;

a latch releasably connecting the first portion to the sub sea isolation system, the latch being movable between an engaged position in which the latch is engaged with the sub sea isolation system and a disengaged position in which the latch is disengaged from the subsea isolation system;

wherein, in use, when the tension in the workover riser exceeds a pre-determined value, relative movement of the second latch portion with respect to the first latch portion from the operating configuration to a displaced configuration permits the latch to move from the engaged position to the disengaged position, releasing the latch device from the sub sea isolation system such that the workover riser is separated from the sub sea isolation system, wherein the latch device further includes a piston and a piston chamber, the piston being adapted to reciprocate within the piston chamber to compensate for the pressure end load force applied to the workover riser by well pressure.

12. The latch device of claim 11, wherein the piston chamber is adapted to receive a fluid.

13. The latch device of claim 12, wherein the piston chamber is adapted to receive fluid, in use, from the workover riser.

14. The latch device of claim 12, wherein the piston chamber is adapted to receive a fluid at well pressure.

15. The latch device of claim 12, wherein in use, the introduction of fluid into the piston chamber results in an increase in pressure in the piston chamber.

16. The latch device of claim 15, wherein an increase in piston chamber pressure acts on the piston.

17. The latch device of claim 16, wherein the pressure applied to the piston is, in turn, applied by the piston, in use, to the workover riser as a counter force, the counter force opposing the end load force.

18. The latch device of claim 17, wherein the counter force applied, in use, by the piston to the workover riser is proportional to the end load force.

19. The latch device of claim 11, wherein the area of the compensation piston is between 75-95% of the area of the latch.

* * * * *